US009424962B2

(12) United States Patent
Cinquemani et al.

(10) Patent No.: US 9,424,962 B2
(45) Date of Patent: Aug. 23, 2016

(54) FLEXIBLE ELECTRICAL CABLE WITH RESISTANCE TO EXTERNAL CHEMICAL AGENTS

(75) Inventors: Paul Cinquemani, Milan (IT); Marco Frigerio, Milan (IT); Flavio Cesa, Milan (IT); Andrew L. Maunder, Milan (IT)

(73) Assignee: PRYSMIAN S.P.A., Milan (IT)

( * ) Notice: Subject to any disclaimer, the term of this patent is extended or adjusted under 35 U.S.C. 154(b) by 596 days.

(21) Appl. No.: 13/518,675

(22) PCT Filed: Dec. 23, 2009

(86) PCT No.: PCT/US2009/069419

§ 371 (c)(1),
(2), (4) Date: Dec. 10, 2012

(87) PCT Pub. No.: WO2011/078865

PCT Pub. Date: Jun. 30, 2011

(65) Prior Publication Data

US 2013/0068497 A1 Mar. 21, 2013

(51) Int. Cl.

| | |
|---|---|
| ***H01B 7/18*** | (2006.01) |
| ***H01B 9/02*** | (2006.01) |
| ***H01B 7/00*** | (2006.01) |
| ***H01B 11/02*** | (2006.01) |
| ***H01B 7/28*** | (2006.01) |

(52) U.S. Cl.
CPC ..... *H01B 7/2813* (2013.01); *Y10T 29/49117* (2015.01)

(58) Field of Classification Search
CPC ..... H01B 7/188; H01B 7/28; H01B 7/2813; H01B 7/285; H01B 7/2855
USPC ... 174/102 R, 105 R, 106 R, 107, 113 C, 116
See application file for complete search history.

(56) References Cited

U.S. PATENT DOCUMENTS 3,526,086 A * 9/1970 Morgan ..... 174/47
3,590,141 A 6/1971 Mildner
3,697,671 A * 10/1972 Parker ..... G01M 3/181 174/102 P (Continued)

FOREIGN PATENT DOCUMENTS

GB 783064 * 9/1957

OTHER PUBLICATIONS

Kabelfabriek (GB783064) provided with Office Action.*

(Continued)

*Primary Examiner* — Chau N Nguyen
*Assistant Examiner* — Roshn Varghese
(74) *Attorney, Agent, or Firm* — Finnegan, Henderson, Farabow, Garrett & Dunner, L.L.P.

(57) ABSTRACT

A flexible electrical cable that is resistant to external chemical agents includes a sheathing assembly and a core assembly. From interior to exterior, the core assembly has at least two conductors and a two-part filler material with an inner portion and an outer portion. The inner portion has discrete, non-continuous elements, and the outer portion is a solid, continuous material surrounding the inner portion and at least partially embedding the at least two conductors. The outer portion has a circular cross-section. The sheathing assembly has a foamed polymeric material formed around and shaped by the outer portion of the filler material, a metal tape positioned around and shaped by the foamed polymeric material, a polymeric coating surrounding the metal tape, and an outer sheath.

15 Claims, 3 Drawing Sheets

(56) References Cited

U.S. PATENT DOCUMENTS

| | | | | | |
|---|---|---|---|---|---|
| 3,745,233 | A | * | 7/1973 | Lania et al. | 174/113 R |
| 3,843,831 | A | * | 10/1974 | Hutchison et al. | 174/116 |
| 4,443,658 | A | * | 4/1984 | Seguin | H01B 7/043 174/113 C |
| 4,600,268 | A | * | 7/1986 | Spicer | 174/113 C |
| 4,707,569 | A | | 11/1987 | Yoshimura et al. | |
| 5,113,040 | A | | 5/1992 | Hose et al. | |
| 5,159,157 | A | * | 10/1992 | Diegmann | H01B 7/0009 174/113 C |
| 5,750,930 | A | | 5/1998 | Buck et al. | |
| 5,902,958 | A | * | 5/1999 | Haxton | 174/47 |
| 6,140,587 | A | * | 10/2000 | Sackett | 174/113 C |
| 6,424,768 | B1 | * | 7/2002 | Booth et al. | 174/116 |
| 7,601,915 | B2 | | 10/2009 | Lumachi et al. | |
| 2008/0190643 | A1 | * | 8/2008 | Lumachi et al. | 174/107 |

OTHER PUBLICATIONS

Definition of "embed" provided from www.dictionary.reference.com May 28, 2015.*

Nederlandsche (GB 783,064) provided with Office Action.*

International Search Report from the European Patent Office for International Application No. PCT/US2009/069419, mailing date Dec. 28, 2010.

* cited by examiner

FLEXIBLE ELECTRICAL CABLE WITH RESISTANCE TO EXTERNAL CHEMICAL AGENTS

TECHNICAL FIELD

The present disclosure relates generally to electrical cables and, more particularly, to electrical power and control cables being resistant to external chemical agents and having enhanced flexibility.

BACKGROUND

Electrical cables generally comprise one or more conductors individually coated with semiconductive and insulating polymeric materials and collectively surrounded with protective coating layers, which are also made of polymeric materials. Depending on the application, such cables may be categorized as low voltage, medium voltage, or high voltage. Typically, "low voltage" means a voltage up to 1 kV, "medium voltage" means a voltage of from 1 kV to 35 kV, and "high voltage" means a voltage greater than 35 kV.

For cables installed in critical environments such as, for example, oil refineries, oil pools, and offshore installations, the permeability of the polymeric cable coatings to humidity and, in particular, to aggressive chemicals presents a problem. These chemicals may be organic such as, for example, hydrocarbons and solvents. They also may be inorganic such as, for example, acids and bases. Penetration to the interior of the cables by the chemical elements compromises the cables' overall lifetime performance in terms of both mechanical and electrical properties.

Thus, electrical power and control cables that are exposed to chemical agents, such as in oil, gas, and petrochemical applications, must be suitable to protect insulated cores from damage caused by such chemicals.

A conventional protection against caustic elements is placement of a lead sheath in a radial internal position with respect to the outermost protective coating layer, i.e. the outer jacket. Lead provides hermetic sealing capability, and is considered relatively easy to extrude in long lengths. Cables of this type are commercially known, for example, as Solid Type PILC cables from The Okonite Company.

Alternatively, welded corrugated aluminum (or copper) sheaths are also known to afford cable protection. Aluminum sheaths are relatively light, provide hermetic sealing capability and may serve as a neutral conductor when placed over power cables. Cables of this type are commercially known, for example, as CL-X® Type cables from The Okonite Company.

In the following description, cables comprising at least a metal protective sheath shall be referred to as "metal clad cables."

The presence of lead or aluminum sheaths adds significant weight to electrical cables. Such sheaths also can make the cables difficult to bend.

To address the limited flexibility of metal clad cables, cable installers have several options. One option is to increase the bending radius that the metal clad cable is pulled around. This approach, however, may wastefully require the use of more cable overall and would not be possible in many circumstances. Another option is to install shorter cable pulls, splicing together the shorter sections to form a desired cable length and shape. This option, however, may unnecessarily increase the installation time.

U.S. Pat. No. 7,601,915 discloses an electrical cable comprising at least one conductor, at least one metallic tape coated with at least one adhesive coating layer and at least one coating layer comprising at least one polyamide or a copolymer thereof. In a radially inner position with respect to the metal tape, a protecting coating layer made of an expanded polymeric material can be provided. In the case of a tripolar cable, the interstices between the insulated conductors are filled with a filler material that forms a continuous structure having a substantially cylindrical shape. The filler material is generally made of elastomeric mixtures or polypropylene fibres, and more preferably is made of a flame-retarding material.

Applicant has observed that the shape of the filler can affect the proper sealing of the metal tape coated with the adhesive layer. In particular, should the outer boundary of the filler material deviate substantially from circularity, the metal tape coated with the adhesive layer may fail to achieve a proper seal or may lose its seal. The loss of a tight seal in the metal tape can jeopardize the cable's ability to resist degradation from external chemical agents. In particular, Applicant has found that if fibrous materials are used as fillers, or the filler material is otherwise discontinuous, the filler may fail to attain or maintain a substantially cylindrical shape, leading to inadequate sealing of the metal tape coated with the adhesive layer.

Applicant has also observed that, while using a solid filler, such as one made of elastomeric mixtures, may be suitable for creating and maintaining a cylindrical shape, the use of a solid filler would decrease flexibility of the cable, which is also detrimental.

Other techniques for filling the interstices of a cable are known, but do not appear to provide adequate balance between the need to maintain the integrity of the metal-tape seal and to keep the cable flexible. For instance, U.S. Pat. No. 4,707,569 discloses a multi-conductor cable such as an electrical cable, a signal-transmission cable or optical fiber cable, including a core made of a plurality of insulated conductors and a sheath surrounding the core. The void space is filled with a plurality of foamed plastic string fillers between the core and the sheath and between the insulated conductors. The string is a composite string formed of a thin strip tape and a foamed plastic layer integrally provided over the surface of the tape. The tape serves as a reinforcing member and is preferably formed of a paper, a non-woven fabric or a plastic film (for example of polypropylene, polyethylene, polybutene, polyester or polyacetal). The filler strings may be used in conjunction with the conventional fillers such as slit yarns, paper tapes and the like. According to this patent, it is preferred that at least 50 vol % of the space fillers filled in the cable be occupied by the foamed plastic strings.

U.S. Pat. No. 5,113,040 discloses a flexible electrical cable including two stranded, rubber-insulated conductors. Two conductors are stranded together with two cable fillers to form a core assembly. Each cable filler includes a rubber strand having a centrally embedded bearing part, which is made up of several non-stranded, high-tensile plastic filaments. The core assembly conductors and cable fillers are first surrounded by a spun covering of a open mesh tape.

U.S. Pat. No. 3,590,141 relates, in one embodiment, to a cable comprising a layer of plastic material that can be either unfoamed or foamed polyethylene or the like and is disposed between the coaxial cables and a layer of hygroscopic material. A layer of hygroscopic material is fashioned of, for example, paper, textile cloth, blend of polymer material and siccative drying agent, or the like.

Applicant has noted that these known approaches to filling voids within a multi-polar cable do not address the problems observed with losing roundness in the outer boundary of the filler material and with having an entirely solid filler region. A design for the filler material avoiding these drawbacks and, therefore, maintaining the integrity of the metal-tape seal and the flexibility of the cable is needed. An electrical cable having such a desired filler material could reliably provide resistance to external chemical agents, provide high mechanical strength and flexibility.

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

SUMMARY

Electrical power and control cables for oil, gas, and petrochemical applications should be suitable to protect insulated conductors from the attack of hydrocarbons, oils and various caustic fluids. Applicant has found that improved flexibility can be achieved in a multi-polar electrical cable having an outer sheath and an overlapping metal tape disposed under the outer sheath and coated with an adhesive layer when a two-part filler system is used between the interstices of the electrical conductors that is formed to have and to maintain a substantially cylindrical shape.

The substantially cylindrical shape, or substantially circular cross-section, helps in achieving and maintaining the seal for the metal tape at its overlap, which ensures the integrity of the cable against caustic substances. As observed by Applicant, conventional multi-polar cables with filler material substantially unapt to be set or maintained in a substantially circular cross-section configuration can cause the seal of the metal tape to be detrimentally breached.

In accordance with one embodiment, a flexible electrical cable resistant to external chemical agents has a sheathing assembly and a core assembly. The sheathing assembly includes an outer sheath and a metal tape disposed under the outer sheath and coated, at least on one surface thereof, with an adhesive layer. The metal tape has overlapping opposing edges sealed to each other by the adhesive layer. The core assembly includes at least two insulated conductors stranded together and a filler system. The sheathing assembly surrounds the core assembly and the filler system. The filler system is a two-part filler system, is disposed between the core assembly and the sheathing assembly, and includes an inner flexible portion and an outer solid layer with a substantially cylindrical shape. The outer solid (i.e. monolithic) layer encapsulates the at least two insulated conductors and the inner flexible portion of the filler system. The at least two insulated conductors are at least partially embedded within the outer solid layer.

The inner flexible portion of the filler system may include a) fibrous elements; b) flexible rods or c) a combination of a) and b).

The fibrous elements a) at least partially fill the volumes between the insulated conductors and the solid outer layer. The fibrous elements a) can be made of a material selected from paper, nylon, polyester, polypropylene, aramid and composites thereof.

The flexible rods b) can be embedded in the fibrous elements a) when present, or in the solid outer layer of the filler system. The flexible rods b) may be made of a material selected from foamed polymer, silicone rubber, polystyrene, chlorosulfonated polyethylene, and mixtures thereof. Foamed polymer, for example foamed EPR or foamed polyethylene, is a preferred material for the flexible rods b). A foamed polymer may enhance the impact resistance of the cable.

Each insulated conductor comprises a central metal portion surrounded by an insulating layer. The central metal portion can be made of a rod or of at least one bundle of stranded wires. The metal can be copper or aluminium. At least one layer of semiconducting material can be provided in radial internal position with respect to the insulating layer. A second layer of semiconducting material can be provided in radial external position with respect to the insulating layer. Optionally, a metal screen can be provided to surround each insulated conductor.

The core assembly may include at least one ground wire stranded around the insulated conductors. The at least one ground wire may be encapsulated by the outer solid layer of the filler system.

The sheathing assembly may include additional layers of protective material. Advantageously, the sheathing assembly comprises a first coating layer disposed between the metal tape and the outer solid layer of the filler system. Preferably, said first coating layer is made of expanded polymeric material. Optionally, a second coating layer may be disposed between the metal tape and the outer sheath. The second coating layer preferably is made of a material comprising at least one polyamide or a copolymer thereof. The second coating layer can be in contact with the adhesive layer coating the metal tape.

The two-part filler system of the cable of the present disclosure helps maintain integrity of the overlapping seal in the metal tape while keeping the cable adequately flexible. The ratio of material within the inner flexible portion and the outer solid layer of the filler system may be selected to achieve cable flexibility while maintaining the cylindrical shape of the outer solid layer and resistance to external chemical agents. Preferably, the inner flexible portion comprises between 30% and 70% of the filler material. More preferably, the inner flexible portion comprises 50% of the material of the filler system.

In accordance with another embodiment, an electrical cable resistant to degradation by external chemical agents, includes, from interior to exterior at least two conductors, a two-part filler system with one part being an outer solid layer, a first coating layer that includes an expanded polymeric material formed around the outer solid layer of the two-part filler system, a metal tape positioned around and shaped by the expanded polymeric material and having overlapping longitudinal edges adhered to each other, a second coating layer (preferably made from a polymeric material) surrounding the metal tape, and an outer sheath.

The two-part filler system of the cable described in the present disclosure includes an inner portion and an outer portion. The inner portion includes discrete, non-continuous elements. In one aspect, the inner portion contains flexible filler materials such as flexible rods or fibrous material. The outer portion is preferably a solid, continuous material surrounding the inner portion and at least partially embedding the at least two conductors. The outer portion has a circular cross-section and is substantially impervious to deformation during cable bending.

It is to be understood that both the foregoing general description and the following detailed description are exemplary and explanatory only and are not restrictive of the invention, as claimed.

The accompanying drawings as summarized below, which are incorporated in and constitute a part of this specification, illustrate embodiments of the invention and together with the description, serve to explain the principles of the invention.

DESCRIPTION OF THE EMBODIMENTS

Figure 1:
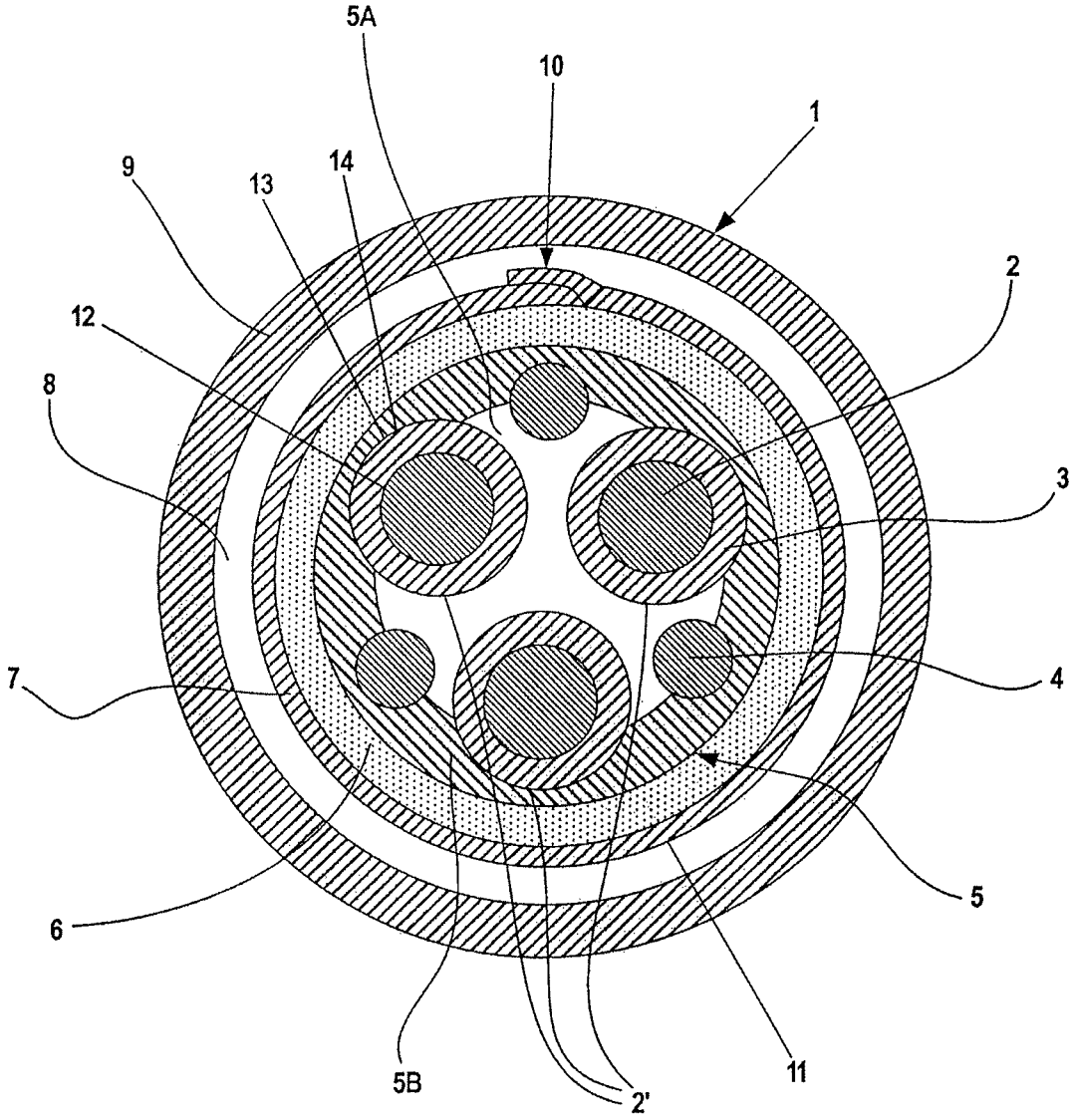
FIG. 1 provides a cross-sectional illustration of an exemplary electrical cable in which the inner flexible portion of filler system is in form of fibrous elements, consistent with certain disclosed embodiments.

Reference will now be made in detail to the present exemplary embodiments of the invention, examples of which are illustrated in the accompanying drawings. The present disclosure, however, may be embodied in many different forms and should not be construed as limited to the embodiments set forth herein. In the drawings, wherever possible, like numbers refer to like elements.

In accordance with one embodiment, an electrical cable suitable for resisting degradation from external chemical agents generally comprises a sheathing assembly and a core assembly. The sheathing assembly includes an outer sheath, a metal tape disposed in radially internal position with respect to the outer sheath, a polymeric coating surrounding the metal tape, and an expanded polymeric material in radially internal position with respect to the metal tape. The metal tape is preferably coated, on at least the radially external surface, with an adhesive layer and has overlapping opposing edges sealed to each other by the adhesive layer. The core assembly, which is surrounded by the sheathing assembly, includes at least two insulated conductors stranded together. A two-part filler system disposed between the core assembly and the sheathing assembly includes an inner flexible portion and an outer solid layer. The outer solid layer has a substantially cylindrical shape and encapsulates the at least two insulated conductors and the inner flexible portion of the filler system. The at least two insulated conductors are at least partially embedded within the outer solid layer.

As from 1 in FIG. 1, the electrical cable may be of the tripolar type having three conductors 2, each covered by an insulating coating layer 3 to form three insulated conductors 2'. Conductors 2 may be constructed of conductive metal, such as copper or aluminum. Insulating layer 3 may be made, for example, from at least one of: crosslinked or non-crosslinked polyolefin-based polymeric material selected from: polyolefins, copolymers of different olefins, copolymers of an olefin with an ethylenically unsaturated ester, e.g. polyacrylates, polyesters, e.g. polyacetates, cellulose polymers, polycarbonates, polysulphones, phenol resins, urea resins, polyketones, polyamides, polyamines, and mixtures thereof. For example, the insulating coating layer 3 comprises either crosslinked ethylene/propylene (EPR) or cross-linked polyethylene.

In the depicted embodiment, the core assembly includes three bare copper ground wires 4, stranded together with the insulated conductors 2'.

The cable 1 includes a two-part filler system 5 disposed between the core assembly and the sheathing assembly. As depicted in FIG. 1, two-part filler system 5 comprises an inner flexible portion 5A and an outer solid layer 5B. The two-part filler system 5 forms a substantially continuous element of a cylindrical shape that fills the interstices among the insulated conductors 2'.

Inner layer 5A of FIG. 1 is made of fibrous elements. For example, said fibrous elements are made of a material selected from paper, nylon, polypropylene, polyester, fiberglass, aramid fibers and composites thereof. Optionally, the material of the fibrous elements may be flame retardant and/or may have wicking properties to absorb excess moisture from the cable. The material of inner flexible portion 5A provides adequate filling of the interstices between insulated conductors 2 while enhancing cable flexibility.

Figure 2A:
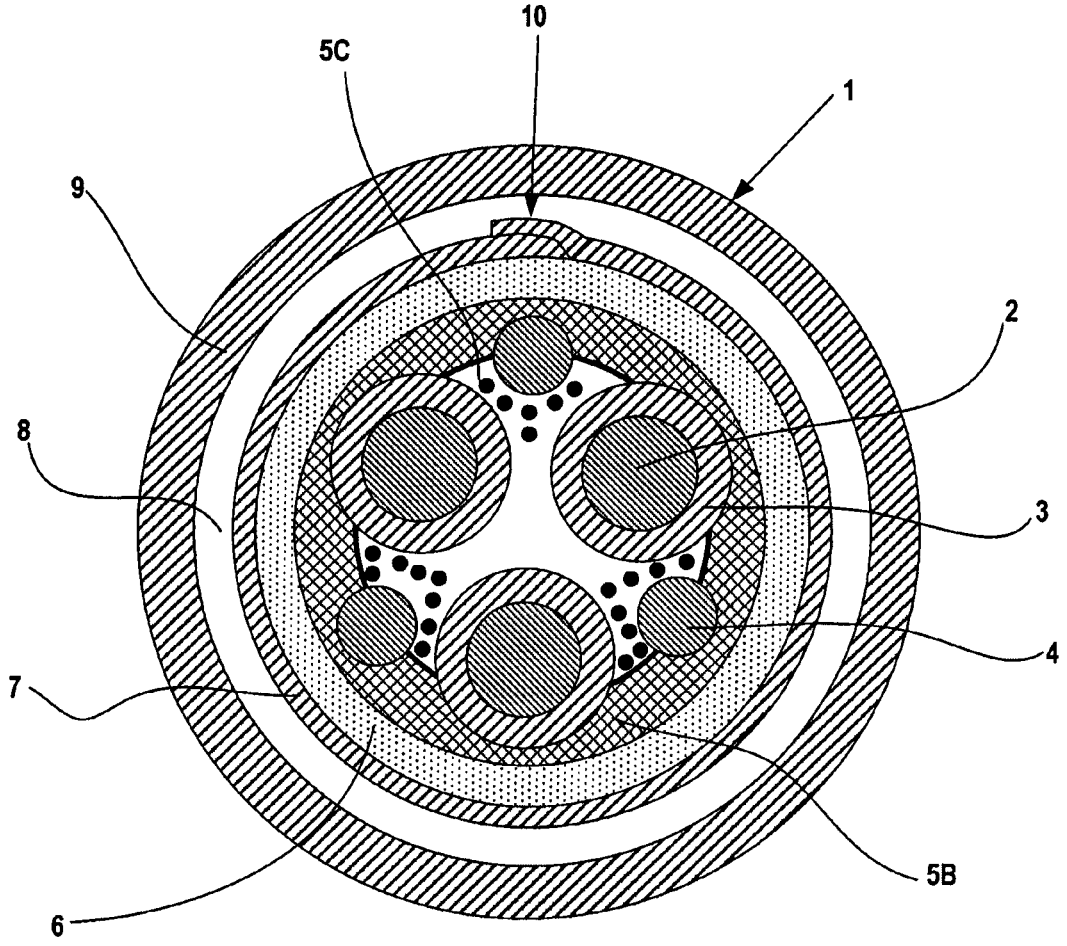
FIG. 2A provides a cross-sectional illustration of an electrical cable wherein the inner flexible portion of filler system is in the form of fibrous elements and flexible rods, consistent with certain other disclosed embodiments.

In another embodiment, inner flexible portion 5A may include flexible rods, in addition to or in place of fibrous material. FIG. 2A illustrates an embodiment of the electrical cable having flexible rods 5C positioned within the inner flexible portion 5A of filler system 5. Flexible rods 5C may be made from, for example, flexible EPR, polystyrene, silicone rubber or flexible chlorosulfonated polyethylene (Tradename HYPALON). Alternatively, flexible rods may be made from a foamed solid material, for example, foamed EPR or foamed polyethylene. A foamed material employed for flexible rods 5C may enhance the impact resistance of the cable compared with an inner flexible portion 5A made of fibrous material only.

As embodied as 5B in FIG. 1, an outer solid layer encircles inner flexible portion 5A. Outer layer 5B forms a continuous structure having a substantially cylindrical shape along at least the majority of the length of the cable. It is contemplated, therefore, that deviations from a cylindrical shape or imperfections, cracks, or other discontinuities with respect to the substantially cylindrical shape may be present in outer layer 5B of filler system 5 along some portions of an extended length of the cable, without departing from the scope of the present disclosure and invention. Outer layer 5B encases and encapsulates the insulated conductors 2' and the inner flexible portion 5A of filler system 5 and has a substantially circular cross-section.

The solid filling material of the outer layer 5B may be constructed of any material that substantially maintains a circular cross-section during manufacture such that it maintains the substantially cylindrical shape when subsequent layers are applied and during cable operation as well. Compared with fibrous materials or flexible rods employed within inner flexible portion 5A, outer layer 5B of filler system 5 is solid and continuous, thereby maintaining the cylindrical shape during application of the external layers—such as during the extrusion of the expanded polymeric material of the first coating layer 6 and during application of metallic tape 7 (discussed below)—over solid layer 5B.

Examples of possible materials for outer solid layer 5B include one or more of: crosslinked or non-crosslinked ethylene/propylene rubber (EPR); crosslinked or non-crosslinked ethylene/propylene/diene (EPDM); elastomeric copolymers; polyvinyl chloride (PVC); crosslinked or non-crosslinked polyolefin based materials; EVA; low smoke zero halogen materials, e.g. the polymers charged with a suitable amount of an inorganic filler such as alumina or magnesium hydroxide; silicone rubbers; and other extrudable materials.

The selection of material for outer solid layer 5B follows from the ability of the outer rigid portion to maintain round cross-section during manufacture, which helps ensure sufficient sealing at the overlapping edges of metal tape 7 (discussed below). For instance, outer solid layer 5B may be made of a solid material, such as an EPDM material formed in a substantially cylindrical shape along the length of the cable. On the other hand, such a material applied as the entire filler material is likely to restrict flexibility of the cable, thus inner flexible portion 5A is provided. Other extruded solid materials, such as flexible chlorosulfonated polyethylene (such as Hypalon®), provide high levels of flexibility for outer solid layer 5B and cable 1.

Outer solid layer 5B surrounds and at least partially embeds the insulated conductors 2'. As illustrated in FIG. 1, outer solid layer 5B contacts and at least partially surrounds insulated conductors 2'. Layer 5B may alternatively completely surround and encapsulate conductors 2, as is shown in the embodiment depicted in FIG. 2B.

Encapsulation of insulated conductors 2' by outer solid layer 5B of filler system 5 is preferably carried out by extruding layer 5B over insulated conductors 2' and inner flexible portion 5A by known techniques. To facilitate extrusion of outer solid layer 5B, a binder in form of thread or tape may optionally be wound around the inner portion 5A of fibrous fillers and/or flexible rods 5C to hold the fibrous material and/or flexible rods to the cable before extruding the outer layer 5B. In this case, the outer solid layer is extruded on a bound inner portion. The binder may be particularly useful on larger size cables to hold the fibrous fillers together on the cable before extruding the outer layer 5B.

Figure 2B:
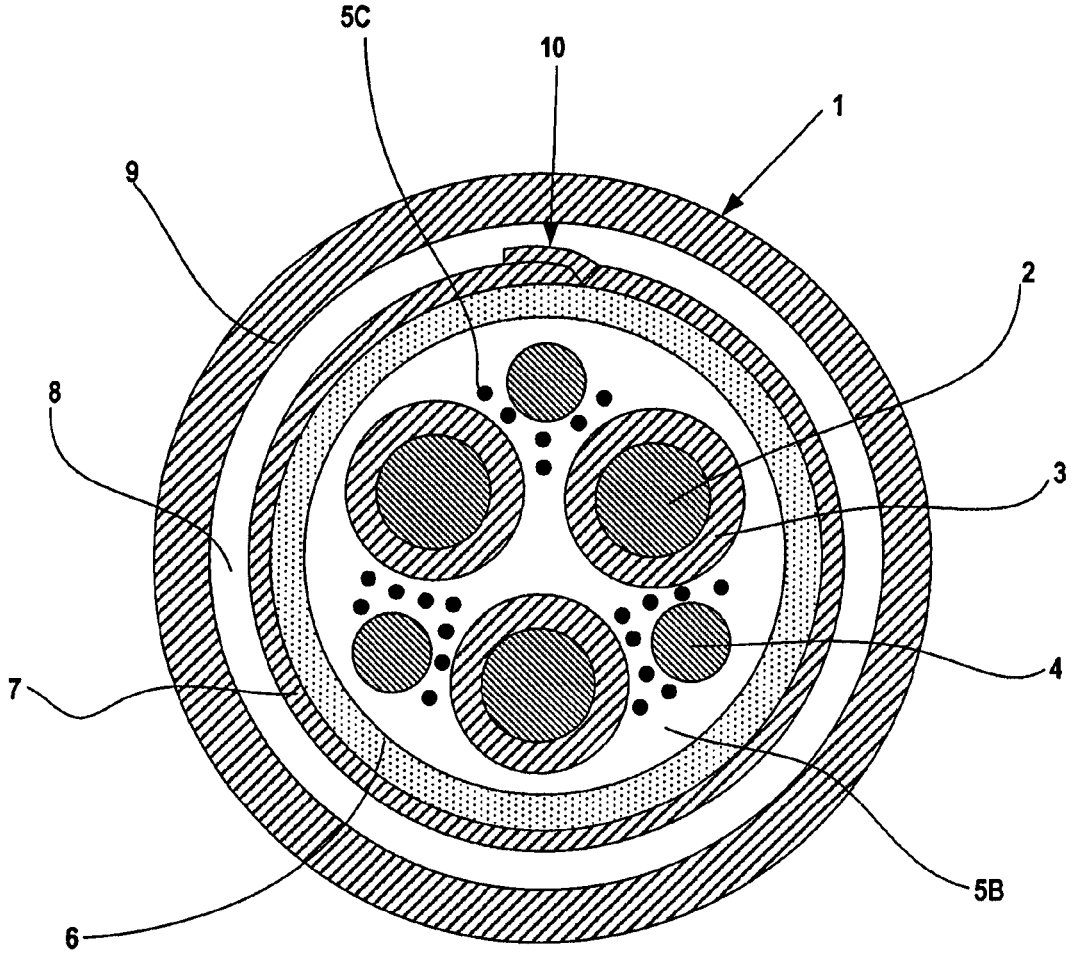
FIG. 2B provides a cross-sectional illustration of an electrical cable wherein the inner flexible portion of filler system is in the form of flexible rods embedded within the outer solid layer of filler system, consistent with certain disclosed embodiments.

FIGS. 2A and 2B depict alternate embodiments for electrical cable 1 showing variations of filler system 5. In FIG. 2A, inner flexible portion comprises flexible rods 5C without additional fibrous material 5A. Outer solid material 5B surrounds and encapsulates insulated conductors 2', as well as ground wires 4. In FIG. 2B, inner flexible portion is made of flexible rods 5C, which, as with insulated conductors 2' and ground wires 4, are embedded in outer solid layer 5B. It will be understood by those skilled in the art that combinations and variations of these arrangements may be employed, such as cable 1 in FIG. 2A having flexible rods 5C partially or fully embedded within outer solid layer 5B and having an inner flexible portion of fibrous material 5A (not shown) within the interstices of insulated conductors 2'.

The proportion of flexible inner portion material to solid outer layer material within filler system may vary based on the intended application. In one embodiment, cable 1 may include an inner flexible portion comprising fibrous material deployed in approximately half the interstices, such that the fibrous material comprises approximately half of the cross-sectional area (or volume) occupied by filler system. Solid outer layer may be extruded over inner portion and take up approximately the remaining area of filler system in cable. With suitable selection of materials, filler system constructed in accordance with this embodiment can provide sufficient flexibility to cable 1 while maintaining the substantially cylindrical profile formed by extrusion of outer layer.

The portion of the cross-sectional area filled by the inner flexible portion material with respect to the outer layer material may be from 30% to 70%. Likewise, the portion of the cross-sectional area filled by the outer layer with respect to the inner flexible portion may be from 30% to 70%.

It will be apparent to those skilled in the art that tradeoffs may be made in selecting the materials for inner flexible portion and outer solid layer and their respective cross-sectional areas, which may affect performance characteristics such as flexibility or cable weight. For instance, selection of a stiffer material for outer layer may permit the thickness of that layer to be less than 50% of the cross section to obtain acceptable flexibility. In general, it is preferred that the selection of materials and thickness ratios for filler system leads to an improvement in cable flexibility of at least 10-20% compared with an entirely solid filler system, although such preference should not be viewed as limiting to the invention as claimed.

Construction of the core assembly preferably occurs following the basic steps disclosed in U.S. Pat. No. 7,601,915 except for the addition of the two-part filler system. Such a two-part material may be applied in any means known in the field, but preferably occurs by first applying fibrous inner material around insulated conductors and then extruding a solid outer layer around the inner material and the conductors.

As from FIGS. 1, 2A and 2B, surrounding the core assembly of insulated conductors 2' and filler system 5 in cable 1 is a sheathing assembly. The sheathing assembly includes a layer of first coating layer 6 of expanded polymeric material, a metal tape 7 disposed over the first coating layer 6, a second coating layer 8 surrounding metal tape 7, and an outer sheath 9. The sheathing assembly is preferably made through cable extrusion processes as described in U.S. Pat. No. 7,601,915, which teachings specific to the structure and assembly processes for the sheathing assembly are hereby incorporated by reference.

First coating layer 6 is formed by extrusion over and around solid outer layer 5B of filler system 5. First coating layer 6 may tend to take the cross-sectional shape of outer solid layer 5B of filler system 5. In accordance with the embodiments disclosed herein, outer solid layer 5B has a circular cross-section that tends to substantially retain such shape when coating 6 is extruded over and when metallic tape 7 is applied over the polymeric coating 6.

First coating layer 6 may be constructed of an expanded polymeric material comprising at least one of: polyolefins, copolymers of different olefins, copolymers of an olefin with an ethylenically unsaturated ester, polyesters, polycarbonates, polysulphones, phenol resins, and urea resins.

According to an exemplary embodiment, the expanded polymer may comprise one of: (i) copolymers of ethylene with an ethylenically unsaturated ester, such as vinyl acetate or butyl acetate, in which the amount of unsaturated ester is of from 5% by weight to 80% by weight; (ii) elastomeric copolymers of ethylene with at least one $C_3$-$C_{12}$ $\alpha$-olefin, and optionally a diene, having the following composition: 35%-90% mole of ethylene, 10%-65% mole of $\alpha$-olefin, 0%-10% mole of diene; (iii) copolymers of ethylene with at least one $C_4$-$C_{12}$ $\alpha$-olefin, and optionally a diene, having a density of from 0.86 g/cm$^3$ to 0.90 g/cm$^3$ and the following composition: 75%-97% by mole of ethylene, 3%-25% by mole of $\alpha$-olefin, 0%-5% by mole of a diene; and (iv) polypropylene modified with ethylene/$C_3$-$C_{12}$ $\alpha$-olefin copolymers, wherein the weight ratio between polypropylene and ethylene/$\alpha$-olefin copolymer is of from 90/10 to 10/90.

Surrounding first coating layer 6 is metal tape 7. Metal tape 7 may be longitudinally folded (or rolled) to form overlapping edges 10 and helps shield the core assembly from caustic chemicals that may breach the cable exterior during operation. According to one exemplary embodiment, the metal tape may be made of aluminum, aluminum alloys, alloy-clad aluminum, copper, bronze, steel, tin free steel, tin plate steel, aluminized steel, stainless steel, copper-clad stainless steel, terneplate steel, galvanized steel, chrome or chrome-treated steel, lead, magnesium, and tin. The metal tape may have a thickness of from 0.05 mm to 1.0 mm. According to certain exemplary embodiments, the metal tape may have a thickness of from 0.1 mm to 0.5 mm.

The metal tape 7 with overlapping edges 10 may be sealed by an adhesive layer. The adhesive layer may have a thickness of from 0.01 mm to 0.1 mm and, preferably, of from 0.02 mm to 0.08 mm. According to one exemplary embodiment, the adhesive layer comprises at least one copolymer of ethylene or propylene with at least one comonomer comprising an ethylenically unsaturated carboxylic acid. The copolymer of ethylene or propylene with at least one comonomer of ethylenically unsaturated carboxylic acid may comprise a copolymer having a major portion of ethylene or propylene and a minor portion, for example, of from 1% by weight to 30% by weight (with respect to the total copolymer weight) of an ethylenically unsaturated carboxylic acid.

The ethylenically unsaturated carboxylic acid, which term includes mono- and poly-basic acids, acid anhydrides, and partial esters of polybasic acids, may include at least one of: acrylic acid, methacrylic acid, crotonic acid, fumaric acid, maleic acid, itaconic acid, maleic anhydride, monomethyl maleate, monoethyl maleate, monomethyl fumarate, monoethyl fumarate, tripropylene glycol monomethyl ether acid maleate, and ethylene glycol monophenyl ether acid maleate.

According to one embodiment, the copolymer of ethylene or propylene with at least one comonomer is selected from ethylenically unsaturated carboxylic acids may be a copolymer of ethylene with acrylic or methacrylic acid or with acrylic or methacrylic ester.

Preferably, the metal tape 7 bears the adhesive 11 on its externally facing surface and is folded lengthwise during assembly into a tubular form so as to surround first coating layer 6. Alternatively, metal tape 7 may bear an adhesive coating layer 11 both on its externally and on its internally facing surfaces. A desirable sealing and bonding agent in the form of a hot melt adhesive may also be applied at the overlapping area of the edges of the metal tape.

Surrounding metal tape 7 is a second coating layer 8. Coating layer 8 comprises at least one polyamide or a copolymer thereof, preferably a polyamide/polyolefin blend and includes one or more of the condensation products of at least one amino acid such as, for example, aminocaproic acid, 7-aminoheptanoic acid, 11-aminoundecanoic acid, 12-aminododecanoic acid, or at least one of lactam, such as caprolactam, oenantholactam, lauryllactam, or of at least one salt or mixtures of diamines such as hexamethylenediamine, dodecamethylene diamine, metaxylylenediamine, bis (p-aminocyclohexyl)-methane, trimethylhexa-methylene, with at least one diacid such as isophthalic acid, terephthalic acid, azelaic acid, suberic acid, sebacic acid, dodecanedicarboxylic acid; or mixtures of all these monomers.

The polyamide or a copolymer thereof may comprise at least one of: nylon 6, nylon 6/12, nylon 11, and nylon 12. The polyamide or a copolymer thereof may be blended with at least one polyolefin. The polyolefin can comprise at least one of: polyethylene, polypropylene, copolymers of ethylene with $\alpha$-olefins, the products being optionally grafted with unsaturated carboxylic acid anhydrides such as maleic anhydride, or by unsaturated epoxides such as glycidyl methacrylate, or mixtures thereof; copolymers of ethylene with at least one product selected from: (i) unsaturated carboxylic acids, their salts or their esters; (ii) vinyl esters of saturated carboxylic acids; (iii) unsaturated dicarboxylic acids, their salts, their esters, their half-esters, or their anhydrides; (iv) unsaturated epoxides; the ethylene copolymers being optionally grafted with unsaturated dicarboxylic acid anhydrides or unsaturated epoxides; styrene/ethylene-butylene/styrene block copolymers (SEBS), optionally maleinized; or blends thereof.

The blend of polyamide or a copolymer thereof with at least one polyolefin may further comprises at least one compatibilizer, including at least one of: polyethylene, polypropylene, ethylene-propylene copolymers, ethylene-butylene copolymers, all these products being grafted by maleic anhydride or glycidyl methacrylate; ethylene/alkyl (meth) acrylate/maleic anhydride copolymers, the maleic anhydride being grafted or copolymerized; -ethylene/vinyl acetate/maleic anhydride copolymers, the maleic anhydride being grafted or copolymerized; the above two copolymers in which the maleic anhydride is replaced with glycidyl (meth) acrylate; ethylene/(meth)acrylic acid copolymers and their salts; polyethylene, polypropylene or ethylene-propylene copolymers, these polymers being grafted with a product having a site which reacts with amines, these grafted copolymers then being condensed with polyamides or polyamide oligomers having a single amine end group.

According to one exemplary embodiment, the blend of polyamide or a copolymer thereof with at least one polyolefin comprises: from 55 parts by weight to 95 parts by weight of polyamide; and from 5 parts by weight to 45 parts by weight of polyolefin.

The second coating layer 8 may have a thickness of from 0.5 mm to 3 mm and, preferably, from 0.8 mm to 2.5 mm. The second coating layer 8 is operatively in contact with the adhesive coating layer on at least one portion of the surface of metal tape 7.

It is contemplated that cable 1 may include additional and/or different components than those listed above such as, for example, one or more ripcords (not shown in the drawings), semiconductive coating layers 12 located radially internal to the insulating coating layers 3, semiconductive layers 13 located radially external to the insulating coating layers 3, spirally wound electrically conducting wires or tapes 14 arranged around the semiconductive layers located radially external to the insulating coating layers 3, and other suitable components that may be associated with cable 1.

The combination of the core assembly and sheathing assembly described above provides an electrical cable with protection against external chemical agents with improved flexibility. An outer solid layer of filler system having a substantially cylindrical shape provides a continuous and solid base for forming expanded first coating layer and metal tape. Having a solid structure that substantially maintains its cross-sectional roundness, outer solid layer helps ensure the integrity of the seam between overlapping edges of metal tape. Moreover, the inner flexible portion of two-part filler system ensures flexibility for cable and generally tends to keep the weight of the cable down compared with a filler material made entirely of the material from outer solid layer.

A cable consistent with the present embodiment was comparatively tested for flexibility according to Cenelec TC20/WG9 against three cables of similar construction having only a solid filler material. All cable samples were 3-Conductor 1/0 AWG (American Wire Gauge) with 10 AWG ground wire. The conductors were insulated with crosslinked polyethylene, had an expanded first coating layer of PVC, metal tape with overlap and adhesive coating, second coating layer of nylon, and protective sheath.

Table 1 shows the construction differences of the three samples. Cable Sample 3 includes data representative of performance of a cable constructed consistent with the disclosed embodiments. In particular, Cable Sample 3 had a filler system comprising a inner flexible portion of paper material and a solid outer layer of EPDM. The ratio of the cross-sectional area between the inner flexible portion and the solid outer layer was about 50/50. Comparative cable Samples 1, 2, and 4 were constructed with monolithic filler system only. Comparative cable Samples 1, 2, and 4 showed similar flexibility. Cable Sample 3 of the invention had an average of 16.2% better flexibility over the comparative cable samples.

TABLE 1

| | Sample 1 | Sample 2 | Sample 3 (as presently disclosed) | Sample 4 |
|---|---|---|---|---|
| Cable Construction | ASTM B172 Class I Flexible Strand Conductors; solid PVC filler | ASTM B8 Class B Strand conductors; solid EPDM filler | ASTM B8 Class B Strand conductors; 50% Paper/50% solid EPDM filler | ASTM B8 Class B Strand conductors; solid PVC filler |
| Flexibility (Kg) | 46.32 | 43.14 | 37.41 | 44.63 |
| % Improved Flexibility of Cable Sample 3 over other samples | 19.2% | 13.2% | — | 16.2% |

The cable constructed consistent with the disclosed embodiments (and used in the flexibility testing reported in Table 1) has passed the IEEE 1202 and FT-4 flame tests for low voltage cables.

It will be apparent to those skilled in the art that various modifications and variations can be made to the structure of the power cable disclosed herein without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical cable, comprising a core assembly and a sheathing assembly surrounding the core assembly, in which:

the sheathing assembly including an outer sheath, a metal tape disposed under the outer sheath and coated at least partially with an adhesive layer, the metal tape having overlapping opposing edges sealed to each other by the adhesive layer; and the core assembly including at least two conductors stranded together with each having an insulating coating layer, and a filler system disposed between the core assembly and the sheathing assembly, the filler system comprising:

an inner flexible portion, and an outer solid layer substantially impervious to deviation from a substantially cylindrical shape encapsulating the at least two conductors and the inner flexible portion along a majority of the length of the cable, wherein the at least two conductors are at least partially embedded within, and at least partially in direct contact with, the outer solid layer.

2. The electrical cable of claim 1, wherein the inner flexible portion of the filler system includes at least one of a) fibrous elements and b) flexible rods.

3. The electrical cable of claim 2, wherein the fibrous elements a) at least partially fill volumes between the insulated conductors and the solid outer layer.

4. The electrical cable of claim 2, wherein the fibrous elements a) are made of a material selected from paper, nylon, polyester, polypropylene, aramid and composites thereof.

5. The electrical cable of claim 2, wherein the flexible rods b) are embedded in the fibrous elements a) or in the solid outer layer of the filler system.

6. The electrical cable of claim 2, wherein the flexible rods b) are made of a material selected from foamed polymer, silicone rubber, polystyrene, chlorosulfonated polyethylene, and mixtures thereof.

7. The electrical cable of claim 6, further comprising a second coating layer, disposed between the metal tape and the outer sheath, the second coating layer comprising at least one polyamide or a copolymer thereof, wherein the second coating layer is in contact with the adhesive layer coating the metal tape.

8. The electrical cable of claim 1, further comprising a first coating layer disposed between the metal tape and the outer solid layer of the filler system, the coating layer comprising expanded polymeric material.

9. The electrical cable of claim 8, wherein the outer sheath is a protective sheath located radially external to a second coating layer.

10. The electrical cable of claim 1, wherein the inner flexible portion comprises about 50% of the filler system.

11. The electrical cable of claim 1, wherein the inner flexible portion comprises between about 30% and about 70% of the filler system.

12. The electrical cable of claim 1, further comprising a first semiconductive coating layer located radially internal to the insulating coating layer and a second semiconductive coating layer located radially external to the insulating coating layer.

13. The electrical cable of claim 12, further comprising a screen comprising spirally wound electrically conducting wires and arranged around the semiconductive coating layer located radially external to the insulating coating layer.

14. A cable resistant to degradation by external chemical agents, comprising, from interior to exterior:

at least two conductors;

a filler system having an inner portion and an outer portion, the inner portion being flexible and comprising discrete, non-continuous elements, the outer portion being a solid, continuous material surrounding the inner portion and at least partially embedding, and being at least partially in direct contact with, the at least two conductors, the outer portion being substantially impervious to deviation from a circular cross-section;

a foamed polymeric material formed around and shaped by the solid outer portion of the filler system;

a metal tape positioned around and shaped by the foamed polymeric material, the metal tape having overlapping longitudinal edges adhered to each other;

a polymeric coating surrounding the metal tape; and an outer sheath enclosing the polymeric coating.

15. A method for making an electrical cable having a filler system, comprising;

arranging a plurality of insulated conductors longitudinally;

positioning discrete, non-continuous elements at least partially within interstices between the insulated conductors as an inner portion of the filler system;

winding a binder around the inner portion to form a bound inner portion;

extruding a continuous solid layer of material around the bound inner portion as an outer layer of the filler system, the extruding process at least partially embedding the plurality of insulated conductors within, and making the insulated conductors at least partially in direct contact with, the outer layer, the outer layer being substantially impervious to deviation from a substantially cylindrical shape;

applying an expanded polymeric material as a first coating layer around the outer solid layer of the filler system;

folding and sealing a metal tape external to the first coating layer; and forming an outer sheath external to the metal tape.

* * * * *